US007578599B2

(12) United States Patent
Moser et al.

(10) Patent No.: US 7,578,599 B2
(45) Date of Patent: Aug. 25, 2009

(54) SPOTLIGHT WITH USER-FRIENDLY FIXABLE ADJUSTABLE FOCUS

(75) Inventors: John Moser, Scottsdale, AZ (US); James Girard, Boise, ID (US)

(73) Assignee: Q-Industries, Inc., Fort Lauderdale, FL (US)

( * ) Notice: Subject to any disclaimer, the term of this patent is extended or adjusted under 35 U.S.C. 154(b) by 65 days.

(21) Appl. No.: 11/764,682

(22) Filed: Jun. 18, 2007

(65) Prior Publication Data

US 2008/0310150 A1 Dec. 18, 2008

(51) Int. Cl.
*F21L 4/00* (2006.01)

(52) U.S. Cl. ..... 362/187; 362/157; 362/158; 362/188

(58) Field of Classification Search ..... 362/187, 362/157, 158
See application file for complete search history.

(56) References Cited

U.S. PATENT DOCUMENTS 4,586,117 A * 4/1986 Collins ..... 362/373
4,814,957 A * 3/1989 Dennis ..... 362/187
7,101,057 B2 * 9/2006 Parker et al. ..... 362/191
D556,352 S * 11/2007 Moser ..... D26/45
2004/0233670 A1 * 11/2004 Linde ..... 362/267
2007/0064415 A1 * 3/2007 Wood ..... 362/205

* cited by examiner

*Primary Examiner*—Ali Alavi
*Assistant Examiner*—Evan Dzierzynski
(74) *Attorney, Agent, or Firm*—Feldman Gale, P.A.; Michael C. Cesarano

(57) ABSTRACT

The present invention is a spotlight with adjustable focus that has a focus fixing mechanism to prevent inadvertent changes to the focus of the light, while still allowing user-friendly intentional adjustment of the focus. The mounting neck of the reflector assembly rotates on threads on the lamp assembly so that the focus of the light may be adjusted. The focus is fixed in position by a plurality of ridges and valleys on the lamp assembly that mate with corresponding ridges and valleys in the neck of the reflector assembly. The neck of the reflector assembly is sufficiently flexible or expandable so that the focus of the lamp may be intentionally changed by applying sufficient rotational force, without requiring the user to physically interact with any sort of detent or locking mechanism. The neck is sufficiently rigid so that the reflector assembly will not rotate as a result of incidental vibrations or movement.

9 Claims, 2 Drawing Sheets

SPOTLIGHT WITH USER-FRIENDLY FIXABLE ADJUSTABLE FOCUS

FIELD OF THE INVENTION

The present invention relates primarily to flashlights, spotlights, or lights powered by batteries.

BACKGROUND OF THE INVENTION

Spotlights and flashlights are available in various shapes and sizes that are well known in the art. Flashlights are typically powered by batteries of various sizes. Flashlights may use LED's, incandescent bulbs, fluorescent bulbs, or any other light emitting device as their light source. Some available flashlights have focusing features that allow the user to focus the beam of light to a desired concentration pattern. However, in order to maintain the focus of the light, the focusing mechanism must be prevented from rotating out of position. If a locking system is employed to prevent the focus of the light from changing, the locking system will have to be disengaged before the focus of the light may be altered. It may be cumbersome for a user to have to disengage a locking system just to alter the focus of the light, especially in low-light settings where a flashlight is likely to be used. In addition, there exist lights in the prior art that employ detent/fixing mechanisms located on the external surface of the light. These external mechanisms may not be sufficiently protected from dirt and debris or physical damage.

SUMMARY OF THE INVENTION

The present invention is a focusable spotlight that allows its user to focus the light pattern to precisely the right position and then maintain that focus. Focusing is accomplished by rotating a reflector assembly on threads attached to a lamp assembly so that the parabolic reflector in the reflector assembly changes position in relation the light source, thus changing the focus of the light pattern.

The present invention provides one set of alternating ridges and valleys on the lamp assembly that mate with another set of alternating ridges and valleys in the reflector assembly for fixing the position of the reflector assembly, and thus the focus of the light. The mating of these alternating ridges and valleys prevents the focus of the light from changing involuntarily, as from vibrations or movement incidental to normal use, while still allowing the user to adjust the focus by applying sufficient rotational force to the reflector assembly.

Additionally, the present invention allows the user to adjust the focus of the light without having to physically interact with, or disengage any sort of focus locking or detent mechanism. The present invention also provides a more durable and reliable means for fixing the focus of a light because of the enclosed nature of the ridges and valleys.

BRIEF DESCRIPTION OF THE DRAWINGS

The invention is illustrated by way of example, and not by way of limitation in the figures of the accompanying drawings, in which.

DETAILED DESCRIPTION OF THE INVENTION

Figure 1:
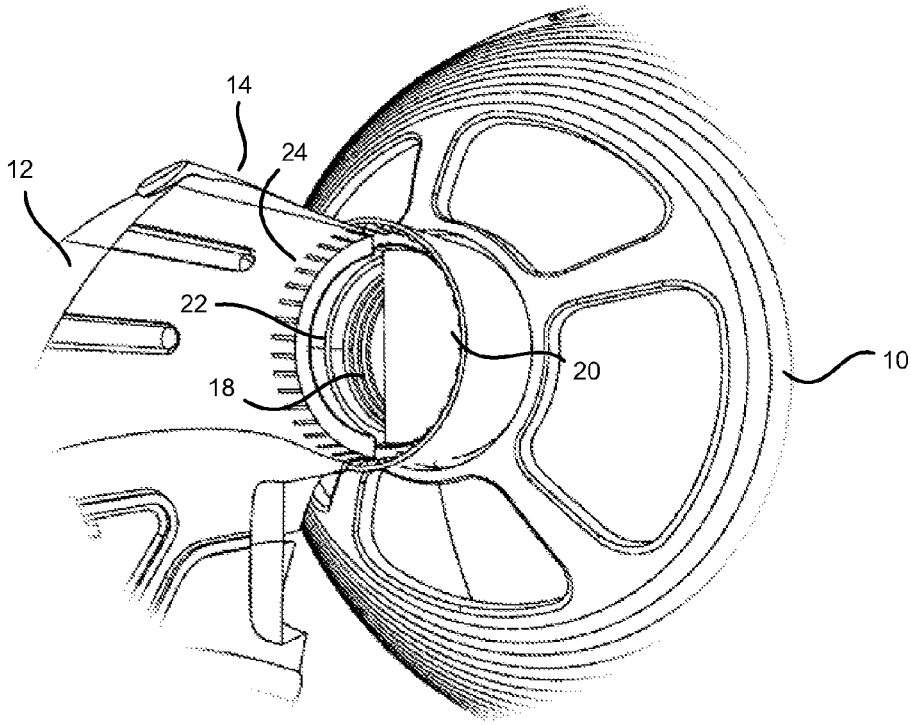
FIG. 1 is an isometric view of the present invention partly cut away.

FIG. 1 is an isometric view of the present invention, which shows the reflector housing 10 mounted on the lamp housing 12. The reflector housing 10 is mounted to the cylindrical mounting member 14 of the lamp housing 12 by its resilient cylindrical neck 16, which has internal threads 18, and a plurality of alternating ridges and valleys 20, that are directed parallel to the axis of the resilient cylindrical neck 16, on its internal surface. The threads 18 on the resilient cylindrical neck 16 mate with the focusing threads 22 on the internal surface of the resilient cylindrical neck 16 mate with alternating ridges and valleys 24 on the external surface of the cylindrical mounting member 14 to fix the focus of the light in a desired position.

Figure 3:
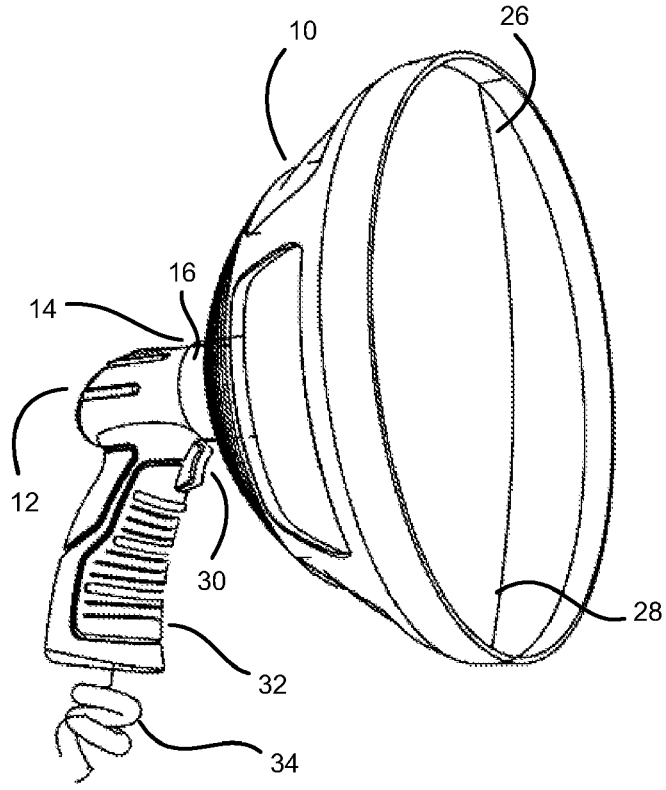
FIG. 3 is an isometric view of the present invention.
Figure 4:
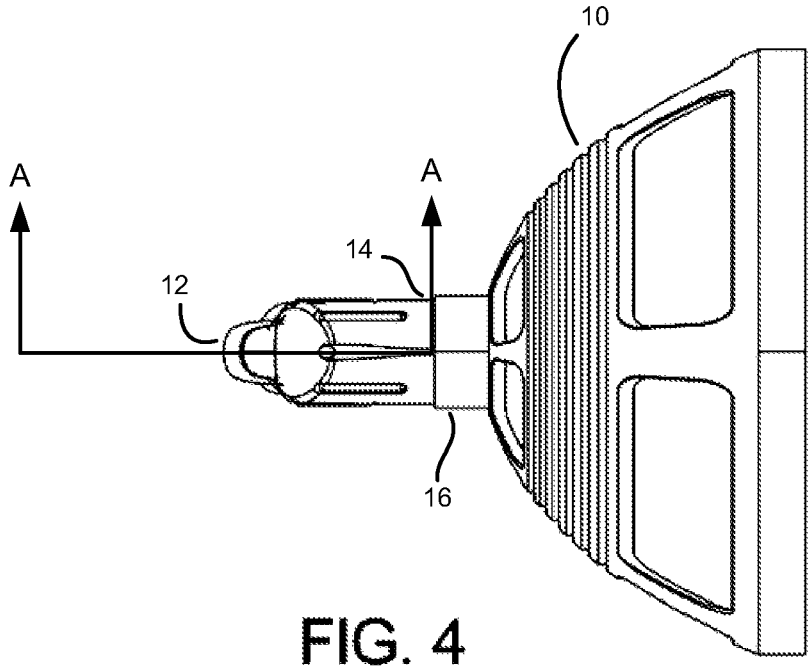
FIG. 4 is a top view of the present invention showing the cutaway section of FIG. 1 along the line A-A in FIG. 4.

The invention may be focused by rotating the reflector housing 10 on the focusing threads 22 so that the parabolic reflector 26, located within the reflector housing 10, as shown in FIG. 3, moves either closer or further away from the cylindrical mounting member 14 and the light source located thereon, thus changing the focus of the light. Once the light is focused in the desired position, the ridges and valleys 20 on the internal surface of the resilient cylindrical neck 16 will be settled within their corresponding ridges and valleys 24 on the cylindrical mounting member 14 to maintain that focusing position. In alternative embodiments of the invention, the ridges 20, 24 may be rounded in shape, or could have a "V" shape, or any other shape that will function correctly, as may be determined by one of ordinary skill in the art.

The resilient cylindrical neck 16 is sufficiently flexible so that as the proper amount of force is applied to rotate the reflector housing, the neck 16 will expand as the ridges 20 on the internal surface of the resilient cylindrical neck 16 move up and over the adjacent ridges 24 on the cylindrical mounting member 14, and into the adjacent valleys 24 on the cylindrical mounting member 14. Thus, the reflector housing 10 is rotated with respect to the lamp housing 12. The amount of rotational force required to adjust the focus in this manner is sufficient, as will be evident to one of ordinary skill in the art, to prevent any inadvertent changing of the focus, while still enabling user-friendly intentional adjustment.

Figure 2:
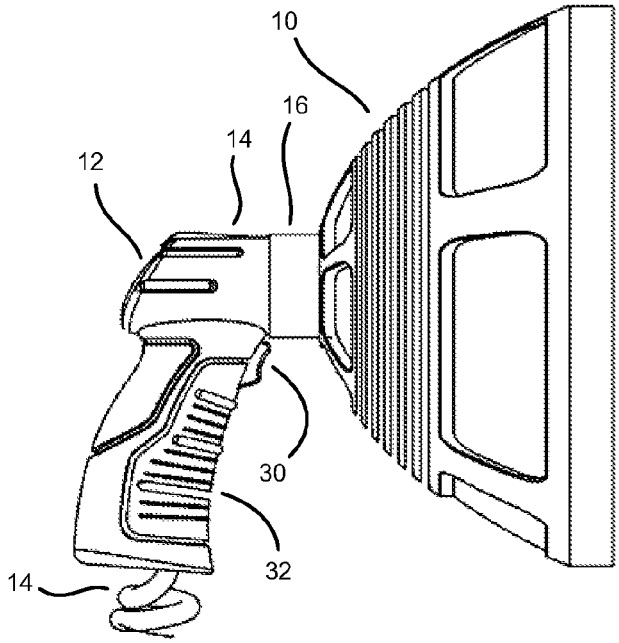
FIG. 2 is a plan side view of the present invention.

In an embodiment of the invention, as seen in FIG. 2 and FIG. 3, a lens 28 is installed in the reflector assembly 10 to protect the parabolic reflector 26 and light source from damage, dirt, debris, moisture, and the like. The lens 28 may be manufactured with suitable characteristics to facilitate the focusing of the light. The lens 28 may be manufactured from glass, plastic, or any other suitable material.

In an embodiment, a switch 30 is mounted on the handle 32 to turn the power to the light source on and off. Additionally, the light may have power cables 34 that extend from the bottom of the handle 32 in order to connect to a power source, such as a battery. The light source of the present invention may be an incandescent light bulb, a halogen light bulb, a fluorescent light bulb, or any other suitable light emitting device, as will be evident to one of ordinary skill in the art.

In an embodiment of the invention, the spotlight may be mounted on the top of a car, on a motorcycle, or on an all terrain vehicle for increased light at night, particularly in rural areas. The spotlight may also be mounted on a boat to increase visibility during nighttime boating. The present invention would maintain the focus of the light pattern even while the vehicle travels over rough terrain or through rough waters.

It is an objective of the present invention to provide a user-friendly focus fixing mechanism that does not require the user to interact with the mechanism itself, but can be adjusted as easily as a light without a fixing or locking mechanism simply by providing adequate rotational force to the reflector housing.

It is a further objective of the present invention to provide a more reliable focus fixing mechanism than currently available alternatives that employ external mechanisms that may be easily deformed or broken.

It is a further objective of the present invention that the mated ridges and valleys, which allow the focus of the light to be maintained, are protected from environmental dirt and debris because of their enclosed nature as illustrated in the accompanying figures.

Although details of specific implementations and embodiments are described above, such details are intended to satisfy statutory disclosure obligations rather than to limit the scope of the following claims. Many changes may be made in the details of construction and the arrangement of components without departing from the spirit and scope of this disclosure. Thus, the invention is defined by the claims, not limited by the specific features described above. The invention is claimed in any form that falls within the proper scope of the appended claims, appropriately interpreted in accordance with the doctrine of equivalents.

What is claimed is:

1. A focusable spotlight comprising:

a lamp assembly having a handle and cylindrical mounting housing, said cylindrical mounting housing comprising a ridged section and a threaded section, said ridged section being located adjacent to said handle and comprising a plurality of alternating ridges and valleys on the external surface thereof, said threaded section being located adjacent to said ridged section and comprising focusing threads on the external surface thereof, said lamp assembly further comprising a light source mounted on the end of said cylindrical mounting housing adjacent to said focusing threads;

a reflector assembly comprising a light source aperture, a reflector, and a resilient cylindrical neck having an internal surface, said reflector comprising an opening for said light source to pass through and being fixed within said reflector assembly such that said opening in said parabolic reflector and said light source aperture are aligned, said resilient cylindrical neck being hollow and protruding from said reflector assembly and extending around said light source aperture; said internal surface of resilient cylindrical neck further comprising mating threads located adjacent to said reflector assembly, and a plurality of alternating ridges and valleys located on the interior surface of said cylindrical neck and being situated adjacent to said mating threads;

said mating threads of said reflector assembly mating with said focusing threads of said cylindrical mounting housing so that said reflector assembly can be attached to said cylindrical mounting housing and rotated with respect to said cylindrical mounting housing to change the distance of said reflector assembly from said light source, said alternating ridges and valleys on said internal surface of said resilient cylindrical neck mating with said alternating ridges and valleys on said external surface of said cylindrical mounting housing whereby said resilient cylindrical neck expands sufficiently to allow said alternating ridges on said internal surface to rise up and over said alternating ridges and down into the next valley on said cylindrical mounting housing so that said reflector assembly can be rotated when sufficient rotational force is applied, and will remain fixed in a desired focusing position when said rotational force is removed.

2. The spotlight of claim 1 wherein said reflector assembly further comprises a lens positioned opposite of the light source aperture.

3. The spotlight of claim 1 further comprising an operable switch on said handle to turn said light source on and off.

4. The spotlight of claim 1 wherein said reflector is a parabolic reflector.

5. The spotlight of claim 1 wherein said light source is an incandescent lamp.

6. The spotlight of claim 1 wherein said light source is a fluorescent lamp.

7. The spotlight of claim 1 wherein said light source is at least one light emitting diode.

8. The spotlight of claim 1 wherein said plurality of alternating ridges and valleys on said ridged section extend completely around said ridged section and said plurality of alternating ridges and valleys on said internal surface of said resilient cylindrical neck extend completely around the internal surface of said resilient cylindrical neck.

9. The spotlight of claim 1 wherein said plurality of alternating ridges and valleys on said ridged section are substantially oriented along the longitudinal axis of said cylindrical mounting housing, and said plurality of alternating ridges and valleys on said internal surface of said resilient cylindrical neck are substantially oriented along the longitudinal axis of said cylindrical neck.

* * * * *